US005834152A

United States Patent [19]

Yasunaga et al.

[11] Patent Number: 5,834,152

[45] Date of Patent: Nov. 10, 1998

[54] CARRIER AND DEVELOPER FOR ELECTROPHOTOGRAPHIC LATENT IMAGE DEVELOPMENT, AND IMAGE FORMING METHOD USING SAME

[75] Inventors: Hideaki Yasunaga, Sakai; Tomoharu Nishikawa, Hirakata; Koichi Takenaka, Itami; Hiroshi Shibano, Takarazuka, all of Japan

[73] Assignee: Minolta,Co., Ltd., Osaka, Japan

[21] Appl. No.: 615,966

[22] Filed: Mar. 14, 1996

[30] Foreign Application Priority Data

| | | | |
|---|---|---|---|
| Mar. 17, 1995 | [JP] | Japan | 7-086237 |
| Apr. 26, 1995 | [JP] | Japan | 7-127168 |
| Jun. 28, 1995 | [JP] | Japan | 7-186265 |

[51] Int. Cl.[6] ..... G03G 9/107

[52] U.S. Cl. ..... 430/122; 430/106.6; 430/108; 430/111; 430/137

[58] Field of Search ..... 430/108, 106.6, 430/111, 137, 122

[56] References Cited

U.S. PATENT DOCUMENTS

| | | | |
|---|---|---|---|
| 4,578,337 | 3/1986 | Oka | 430/107 |
| 4,600,675 | 7/1986 | Iwasa et al. | 430/106.6 |
| 4,822,709 | 4/1989 | Ohtani et al. | 430/106.6 |
| 4,847,176 | 7/1989 | Sano et al. | 430/106.6 |
| 5,472,817 | 12/1995 | Shibano et al. | 430/106.6 |

FOREIGN PATENT DOCUMENTS

| | | | |
|---|---|---|---|
| 58-140753 | 8/1983 | Japan . | |
| 62-217254 | 9/1987 | Japan | 430/108 |
| 5-273789 | 10/1993 | Japan | 430/108 |
| 6-175410 | 6/1994 | Japan . | |

OTHER PUBLICATIONS

Patent & Trademark Office English–Language Translation Of JP 6–175410 (Pub. Jun. 1994).

Patent & Trademark Office English–Language Translation Of JP 62–217254 (Pub. Sep. 1987).

Patent & Trademark Office English–Language Translation Of JP 5–273789 (Pub Oct. 1993).

*Primary Examiner*—Janis L. Dote

[57] ABSTRACT

Carrier particles for electrostatic latent image development comprising first particles comprising a binder resin and a magnetic powder dispersed therein and second particles comprising a binder resin and a magnetic powder dispersed therein, said second particles having an average particle size smaller than said first particles, said magnetic powder contained in the first particles has a residual magnetization smaller than that of said magnetic powder contained in the second particles.

33 Claims, 4 Drawing Sheets

CARRIER AND DEVELOPER FOR ELECTROPHOTOGRAPHIC LATENT IMAGE DEVELOPMENT, AND IMAGE FORMING METHOD USING SAME

BACKGROUND OF THE INVENTION

1. Field of the Invention

The present invention relates to a carrier and developer for electrostatic latent image development in image forming apparatuses such as copying machines, printers, facsimiles and the like. The present invention further relates to an image forming method using the carrier or developer.

2. Description of the Related Art

In conventional image forming apparatuses such as copying machines, printers, facsimiles and the like, two-component developers comprising a carrier and a toner are widely used as developers for developing electrostatic latent images formed on an image-bearing member such as a photosensitive member or the like.

In recent years, developers having small size particles for forming high quality images have come to be used in the aforementioned image forming apparatuses. When a developer having a small particle size is used, however, a disadvantage arises in that developer flowability decreases or electrification build-up of toner is poor.

In order to improve developer flowability, Japanese Unexamined Patent Application No. SHO 58-140753 discloses a carrier combining a small particle size carrier and a resin-coated large particle size carrier. This carrier, however is disadvantageous insofar as chargeability is inadequate.

SUMMARY OF THE INVENTION

An object of the present invention is to provide a novel carrier or developer.

Another object of the present invention is to provide a carrier and developer which eliminate the previously described disadvantages.

Still another object of the present invention is to provide a novel and useful developer and novel carrier for use with said developer for developing electrostatic latent images formed on an image-bearing member such as a photosensitive member or the like in image forming apparatuses such as copying machines, printers, and facsimiles.

Another object of the present invention is to provide a carrier and developer which provide excellent flowability for the developer.

Another object of the present invention is to provide a carrier and developer which provide excellent chargeability for toner.

Another object of the present invention is to provide a carrier and developer providing suitable toner charging and excellent and stable image formation even when using a small particle size toner.

Still another object of the present invention is to provide a carrier and developer capable of producing excellent solid images and excellent halftone images.

A still further object of the present invention is to provide a carrier and developer which prevent do not produce non-printing spots in formed images nor cause carrier adhesion on an image-bearing member even when the toner concentration in the developer is low.

An even further object of the present invention is to provide an image forming method capable of producing excellent images.

The aforementioned objects are attained by the preferred embodiments of the present invention using carrier particles having a structure of:

first particles comprising a binder resin and a magnetic powder dispersed therein; and second particles comprising a binder resin and a magnetic powder dispersed therein, said second particles having an average particle size smaller than said first particles.

The aforementioned objects are attained by the preferred embodiments of the present invention using carrier particles having a structure of:

a binder resin and a magnetic powder dispersed therein, said carrier particles having at least two peaks in a particle size distribution.

The aforementioned objects are attained by the preferred embodiments of the present invention using carrier particles having a structure of:

first particles comprising a binder resin and a magnetic powder dispersed therein; and second particles comprising a binder resin and a magnetic powder dispersed therein, said first particles having a saturated magnetization smaller than that of said second particles.

The aforementioned objects are attained by the preferred embodiments of the present invention using carrier particles having a structure of:

first particles comprising a binder resin and a magnetic powder dispersed therein; and second particles comprising a binder resin and a magnetic powder dispersed therein, said magnetic powder contained in the first particles having a residual magnetization smaller than that of said magnetic powder contained in the second particles.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DESCRIPTION OF THE PREFERRED EMBODIMENTS

Figure 1:
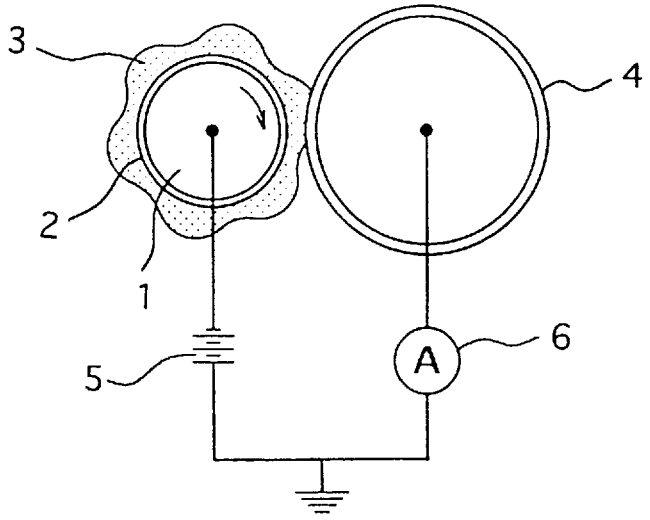
FIG. 1 illustrates the principle of measuring the dynamic current value of the carrier.

The carrier of the preferred embodiments of the present invention comprises a first carrier of magnetic powder dispersed in binder resin, and a second carrier of magnetic powder dispersed in binder resin and having an average particle size smaller than the first carrier, or a saturated magnetization greater than the first carrier, or a residual magnetization of magnetic powder contained therein greater than the residual magnetization of the magnetic powder contained in the first carrier. The carrier of the preferred embodiments of the present invention have magnetic powders dispersed in binder resin and have at least two peaks in particle size distribution. The carrier of magnetic powder dispersed in binder resin in the following description is designated "binder-type carrier".

Both developer flowability and toner mixing characteristics, particularly ability to incorporate replenished toner are improved, and excellent developer flowability and chargeability are maintained by using two kinds of binder-type carriers having different average particle sizes, two kinds of binder-type carriers having different saturated magnetization values, two kinds of binder-type carriers having different residual magnetization values of magnetic powder dispersed in the binder resin, or binder-type carriers having two peaks in particle size distribution. Furthermore, carrier can be prevented from adhering to the image-bearing member. In addition, a softer magnetic brush head can be formed compared to carriers directly using iron, ferrite or the like, so as to prevent streak-like irregularities when developing halftone images such as photographs, and white streaks in solid images. Even further, the leakage of charge on the image-bearing member through the carrier and white spots in the image can be prevented, and adhesion of carrier to the image-bearing member due to charge injection from the developing sleeve can be prevented even when toner concentration in the developer is reduced because the intrinsic volume resistivity can be increased.

The average particle size of the first carrier is desirably 80~150 μm, and preferably 80~100 μm. When the average particle size of the first carrier is less than 80 μm and the first carrier is used together with the second carrier, developer flowability may not be adequately improved and there is concern that carrier adhesion may readily occur. When the average particle size of the first carrier is greater than 150 μm and the first carrier is used together with the second carrier, there is concern that toner chargeability will be adversely affected.

The average particle size of the second carrier is desirably 15~50 μm, and preferably 20~40 μm. When the average particle size of the second carrier is less than 15 μm and said second carrier is used together with the first carrier, there is concern that carrier adhesion will readily occur. When the average particle size of the second carrier is greater than 50 μm and the second carrier is used together with the first carrier, there is concern that toner chargeability will be adversely affected.

Saturated magnetization and residual magnetization of the carriers (external magnetic field strength: 1 KOe) were measured using a direct current magnetization characteristic auto-recording device (model 3257; made by Yokogawa Hokushin Denshi KK).

The saturated magnetization of the first carrier is desirably 50 emu/g or less, preferably 35~50 emu/g, and ideally 45~50 emu/g. When the saturated magnetization of the first carrier exceeds 50 emu/g and the first carrier is used together with the second carrier, developer flowability may be adversely affected and there is concern of inadequate fine line reproducibility.

The saturated magnetization of the second carrier is desirably 55 emu/g or greater, preferably 55~80 emu/g, and ideally 55~65 emu/g. When the saturated magnetization of the second carrier is less than 55 emu/g and the second carrier is used together with the first carrier, there is concern of carrier adhesion.

The residual magnetization of the magnetic powder contained in the first carrier is desirably 13 emu/g or less, preferably 0.1~13 emu/g, and preferably 1.0~10 emu/g. When the residual magnetization exceeds 13 emu/g and the first carrier is used together with the second carrier, there is concern of poor flowability of the developer.

The residual magnetization of the magnetic powder contained in the second carrier is desirably 17~30 emu/g, and preferably 17~25 emu/g. When the residual magnetization of the magnetic powder contained in the second carrier is less than 17 emu/g and the second carrier is used together with the first carrier, there is concern of inadequate improvement of the mixing characteristics with the toner. When the residual magnetization of the powder contained in the second carrier exceeds 30 emu/g and the second carrier is used together with the first carrier, there is concern of inadequate developer flowability.

The residual magnetization of the first carrier is desirably 15 emu/g or less, preferably 10 emu/g or less, and ideally 0.01~10 emu/g. When the residual magnetization of the first carrier exceeds 15 emu/g and the first carrier is used together with the second carrier, there is concern of inadequate flowability of the developer.

The residual magnetization of the second carrier is desirably 16~30 emu/g, and preferably 16~25 emu/g. When the residual magnetization of the second carrier is less than 16 emu/g and the second carrier is used together with the first carrier, there is concern that there will be inadequate improvement of mixing characteristics with the toner. When the residual magnetization of the second carrier exceeds 30 emu/g and the second carrier is used together with the first carrier, there is concern of inadequate developer flowability.

The mixing ratio of the first carrier and second carrier is desirably such that the second carrier content is 30~70 percent by weight of the total carrier, and preferably 30~50 percent by weight of the total carrier. When the second carrier content is less than 30 percent by weight and the second carrier is used with the first carrier, there is concern that the ability to incorporate replenished toner in particular will be reduced so as to cause inadequate toner charging and carrier adhesion. When the second carrier content exceeds 70 percent by weight and the second carrier is used together with the first carrier, there is concern of inadequate improvement of developer flowability.

Examples of useful carrier binder resins include styrene-type resin such as styrene resin and the like, acryl-type resin such as (meth)acrylic resin and the like, styrene-acryl-type resin such as styrene-acrylic copolymer and the like, polyolefin resin, polyester resin, epoxy resin and the like.

Examples of useful magnetic powder for dispersing in the binder resin of the carrier include magnetic metals such as iron, nickel, cobalt and the like, mixtures and alloys of the magnetic metals and metal such as zinc, antimony, aluminum, lead, tin, bismuth, barium, manganese, selenium, tungsten, zirconium, vanadium and the like, mixtures of the magnetic metals and metal oxides such as titanium oxide, magnesium oxide and the like, as well as ferromagnetic ferrite, magnetite and the like.

The primary particle size of the magnetic powder is desirably 5 μm or less, more preferably 2 μm or less, and ideally 0.1~1 μm. When the primary particle size of the magnetic powder exceeds 5 μm, there is concern that the magnetic powder will not be uniformly dispersed in the binder resin.

The amount of magnetic powder contained in the binder resin of the carrier is desirably 200~950 parts by weight relative to 100 parts by weight of binder resin. Specifically, in the case of the first carrier, magnetic powder in an amount of 200~500 parts by weight relative to 100 parts by weight binder resin is desirable, and in the case of the second carrier, magnetic powder in an amount of 600~950 parts by weight relative to 100 parts by weight binder resin is desirable.

In order to improve the dispersability of the magnetic powder in the binder resin of the carrier, dispersing agents such as carbon black, silica, titania, alumina and the like may be added. The amount of added dispersing agent is desirably 0.01~10 percent by weight, and preferably 0.01~3 percent by weight, relative to the carrier.

The aforementioned carriers may be manufactured by, for example, methods wherein binder resin and magnetic powder are mixed and heated, then cooled and subsequently pulverized and classified; and methods wherein magnetic powder is dispersed in a resin solution of binder resin dissolved in solvent and subsequently spray dried.

Carrier particles which a magnetic powder adheres to the surface thereof may be used as the first carrier particles. Magnetic powder adhesion to the surface of the first carrier increases the charging points of the first carrier, and improves chargeability for the small particle size toner, such that, for example, background fog can be reduced thereby.

The specific surface area of magnetic powder adhering to the surface of the first carrier is desirably 8~12 $m^2/g$, and preferably 8~10 $m^2/g$. The number of charging points and electric resistance of the first carrier can be set at desirable values by providing the magnetic powder adhering to the surface of the first carrier with a specific surface area of 8~12 $m^2/g$. The magnetic powder adhering to the surface of the first carrier may be used in the range of 50~200 parts by weight relative to 100 parts by weight of binder resin used in the first carrier.

Methods to make the magnetic powder adhere to the surface of the first carrier include methods wherein a mechano-fusion system which processes by heat-fusing the surface of the carrier via the action of friction with the powder particles is used so as to incorporate the magnetic powder in the surface of the first carrier, and methods wherein a Surfusing System (made by Japan Pneumatic Industries Co.) or like airflow heating system is used for heat-fusing the resin surface of the first carrier to make the magnetic powder adhere to the surface of the carrier particles. The mechano-fusion system is particularly advantageous from the perspective of carrier yield. An example of a mechano-fusion system is Angmill (made by Hosokawa Micron K.K.) which accomplishes processing via passage through a narrow space between a cylindrical vessel rotating at high speed, and a small chipper having a radius of curvature smaller than the vessel.

When the carrier which has magnetic powder adhering to its surface is used as the first carrier, the desirable amount of magnetic powder content dispersed in the binder resin of the first and second carriers is 250~350 parts by weight relative to 100 parts by weight of binder resin in the case of the first carrier, and 600~750 parts by weight relative to 100 parts by weight binder resin in the case of the second carrier.

A smoothness process to the surface of the first carrier may be used. The elimination of angles by smoothness processing of the surface of the first carrier improves the flowability of the developer. Smoothness processing further improves the chargeability of the developer and reduces image density irregularities and the like, as well as reduces carrier adhesion on the imagebearing member.

Smoothing of the surface of the first carrier may be accomplished by processes using a mechano-fusion system such as the Angmill (made by Hosokawa Micron K.K.). When the first carrier has been subjected to surface smoothness processing, it is desirable that the aerated apparent density is 1.400 g/cc or greater from the perspective of flowability of the first carrier itself.

Binder-type carriers having two peaks in particle size distribution may be obtained by, for example, mixing the aforementioned first carrier and a second carrier having a different particle size from the first carrier.

One peak in particle size distribution in the range of 15~50 $\mu$m, and another peak in the range of 80~150 $\mu$m, are desirable.

The saturated magnetization of a carrier ultimately obtained by mixing the previously mentioned first carrier and second carrier is desirably 45~65 emu/g, and preferably 50~60 emu/g, and the residual magnetization is desirably 20 emu/g or less, and preferably 15 emu/g or less.

Toners used in combination with the above-described carriers will desirably have a volume-average particle size of 9 $\mu$m or less, and preferably 4~9 $\mu$m. Using a small particle size toner having a volume-average particle size of 9 $\mu$m or less allows higher resolution images to be obtained. Toners manufactured by well-known methods may be used as the aforementioned toner. For example, toner manufactured by suspension polymerization method, pulverization method, microencapsulation method, spray dry method, mechano-chemical method and the like may be used.

Although the present invention is described hereinafter by way of specific experimental examples, it is not limited to these examples.

Production of Carrier a

To a henschel mixer were added 300 parts by weight ferrite powder having a specific surface area of 7.4 $m^2/g$ and particle size of 0.5 $\mu$m (MFP-2; made by TDK K.K.), 100 parts by weight polyester resin (Tafton NE1110; made by Kao K.K.), 2 parts by weight carbon black (Ketchen black; Lion Yushi K.K.), and 1.5 parts by weight silica (#200; made by Nippon Aerosil K.K.) which were thoroughly mixed, then fused and kneaded by a pressure kneader. After cooling, the kneaded material was coarsely pulverized using a feather mill, finely pulverized using a jet mill, then classified by an air classifier. The obtained particles were heat processed using a Surfusing System (made by Japan Pneumatic Industries Co.) to obtain carrier particles A having an average particle size of 90 $\mu$m.

To the carrier particles A were added 100 parts by weight small particle size ferrite powder having a specific surface area of 9.6 $m^2/g$ relative to 100 parts by weight of binder resin used in the carrier particles A, and mixed. This mixture was processed using Angmill (made by Hosokawa Micron K.K.) to make the ferrite powder adhere to the surface of the carrier particles A and obtain carrier a. The adhesion process was conducted for 10 min at a friction heat of about 90° C.

Production of carrier b

Carrier b was produced by heat processing 3,000 g of a mixture of carrier particles A obtained in the production of carrier a and ferrite powder using the previously mentioned Surfusing System to make the ferrite powder adhere to the surface of the carrier particles. The conditions of heat processing for the ferrite adhesion were a temperature of 500° C., transport air of 8 nL/h, and airflow of 0.3 $Nm^3$/min.

Production of carrier c

Carrier c was produced in the same procedure as carrier a with the exception that the amount of added ferrite powder was 400 parts by weight, and the ferrite powder adhesion process was not performed. Carrier c has an average particle size of 90 $\mu$m.

Production of Carrier d

Carrier d was produced in the same procedure as carrier a with the exception that the amount of added ferrite powder was 700 parts by weight, and the ferrite powder adhesion process was not performed. Carrier c has a mean particle size of 40 μm.

Measurement of Saturated Magnetization, Residual Magnetization, and Dynamic Current Saturated magnetization and residual magnetization of carriers a~d (external magnetic field strength: 1 KOe) were measured using a direct current magnetization chracteristic autorecording device (model 3257; made by Yokogawa Hokushin Denshi K.K.). The dynamic current of each of the aforementioned carriers was measured by the measuring device shown in FIG. 1. The measuring device shown in FIG. 1 comprises a sleeve roller 2 provided with an internal magnet roller 1 and having a magnetic flux density of 1,000 Gauss, an electrode tube 4 disposed opposite sleeve roller 2 with an open space of 1 mm therebetween, a power source 5 for applying a voltage between said sleeve roller 2 and said electrode tube 4, and an ammeter 6 for detecting the DC current flowing to electrode tube 4. When measuring the dynamic current, 5 g of carrier specimen is supplied to sleeve roller 2 and magnet roller is rotated at a speed of 50 rpm, while a bias voltage of 500 V is supplied from power source 5. The value of the direct current flowing through the carrier specimen to electrode tube 4 is measured by ammeter 6, and the value is designated the dynamic current. Measurement results are shown in Table 1.

TABLE 1

| | Carrier a | Carrier b | Carrier c | Carrier d |
|---|---|---|---|---|
| Average Particle Size [μm] | 90 | 90 | 90 | 40 |
| Residual Magnetization [emu/g] | 9.8 | 9.9 | 10.0 | 15.5 |
| Saturated Magnetization [emu/g] | 47.0 | 45.6 | 46.8 | 58.6 |
| Dynamic Current [nA] | 56 | 53 | 17 | 95 |

The carriers of examples 1~10 were prepared using the previously described carriers a~d as follows.

Experimental Examples 1~3

Carrier a and carrier d were mixed to prepare carriers of experimental examples 1~3. The content of carrier d was 30 percent by weight in experimental example 1, 40 percent by weight in experimental example 2, and 50 percent by weight in experimental example 3.

Experimental Examples 4~6

Carrier b and carrier d were mixed to prepare carriers of experimental examples 4~6. The content of carrier d was 30 percent by weight in experimental example 4, 40 percent by weight in experimental example 5, and 50 percent by weight in experimental example 6.

Experimental Examples 7 and 8

In experimental example 7, carrier c was used by itself. In experimental example 8, carrier d was used by itself.

Experimental Examples 9 and 10

Carrier c and carrier d were mixed to prepare carriers of experimental examples 9 and 10. The content amount of carrier d was 30 percent by weight in experimental example 9, and 40 percent by weight in experimental example 10.

Measurement of Saturated Magnetization, Residual Magnetization, Dynamic Current, and Charge Amount Changing Range The residual magnetization, saturated magnetization and dynamic current of the various carriers of experimental examples 1~10 were measured in the same procedure as previously described.

The range of change in the amount of toner charge was measured when the deterioration occurred in the rising direction and when the deterioration occurred in the falling direction in the procedure described below.

Specimens of carriers that exhibited deterioration of toner charge in the rising direction were prepared by adding 1.5 mg teflon particles (TFO-V; made by Central Glass Co.) to 10 g of each of the example carriers, and mixing the materials in a roll mill for 5 hr at 120 rpm. Specimens of carriers that exhibited deterioration of toner charge in the falling direction were prepared by adding 1.5 mg Charge controlling agent (azo dye of chromium complex type; S-34; made Orient Kagaku Kogyo K.K.) to 10 g of each of the example carriers, and mixing the materials in a roll mill for 12 hr at 120 rpm.

Next, toner having a particle size of 8 μm (Di-30 Toner; made by Minolta Co., Ltd.) was added to the carrier exhibiting a deterioration in the charge rising direction to obtain a developer having a toner concentration of 3 percent by weight. Ten grams of this developer was mixed in a roll mill for 60 min at 120 rpm, and the amount of toner charge ($C_1$) was measured. Toner having a particle size of 8 μm (Di-30 Toner; made by Minolta Co., Ltd.) was added to the carrier exhibiting a deterioration in the charge falling direction to obtain a developer having a toner concentration of 7 percent by weight. Then, the obtained developer was mixed in a same manner as described above and the amount of toner charge ($C_2$) was measured. The difference in the amount of measured toner charge between $C_1$ and $C_2$ was calculated as the range of charge amount changing. Measurement results are shown in Table 2.

TABLE 2

| Experimental Example | Residual Magnetization of carrier particles [emu/g] | Saturated Magnetization of carrier particles [emu/g] | Dynamic Current [nA] | Charge Amount Changing Range [μC/g] |
|---|---|---|---|---|
| 1 | 11.6 | 51.6 | 69 | 13.7 |
| 2 | 12.5 | 53.4 | 79 | 13.2 |
| 3 | 13.2 | 54.4 | 82 | 12.6 |
| 4 | 11.4 | 50.6 | 61 | 14.3 |
| 5 | 12.0 | 53.0 | 67 | 14.0 |
| 6 | 12.8 | 53.2 | 74 | 13.0 |
| 7 | 10.0 | 46.8 | 17 | 19.2 |
| 8 | 15.5 | 58.6 | 95 | 11.5 |
| 9 | 12.0 | 52.6 | 40 | 16.8 |
| 10 | 12.6 | 54.5 | 48 | 15.4 |

Measurement of Carrier Collection Amount, Background Fog, and Developer Inclination and Flocculation Toner having a particle size of 8 μm (Di-30 Toner made by Minolta Co., Ltd.) was added to the various carriers of experimental examples 1~10 to obtain developers having a toner concentration of 4~5 percent by weight, the obtained developers were loaded in a commercial copying machine (model Di-30; made by Minolta Co. Ltd.) and 10,000 copies were made in continuous copying. The amount of carrier contained in the developer collected by the cleaning device within the copying machine (amount of collected carrier) was measured. Furthermore, the condition of background fog occurring when toner was replenished, and the occurrence of developer inclination and flocculation within the developing device was also investigated.

The amount of collected carrier was evaluated by baking the developer collected by the cleaning device and determining the carrier content. The evaluation standards were as follows: ○ indicates a carrier content of 0~80 mg/1,000 sheets; Δ indicates a carrier content of 80~120 mg/1,000 sheets; and X indicates a carrier content of 120 mg or more per 1,000 sheets.

Background fog was evaluated by making copies while continuously replenishing toner under low humidity conditions of 30% humidity, and visually checking the condition of fog in the white image areas. The evaluation standards were as follows: ◎ indicates no fog; ○ indicates slight fog posing no problem for image quality; Δ indicates borderline level fog just acceptable; and X indicates severe fog affecting image quality.

The presence of inclination and flocculation of the developer in the developing device was evaluated by visual inspection. The evaluation standards were as follows: ○ indicates the absence of flocculate and developer inclination; and X indicates the presence of flocculate and developer inclination. Evaluation results are shown in Table 3.

TABLE 3

| | Experimental Examples | | | | | | | | | |
|---|---|---|---|---|---|---|---|---|---|---|
| | 1 | 2 | 3 | 4 | 5 | 6 | 7 | 8 | 9 | 10 |
| Amount of Collected Carrier | ○ | ○ | ○ | ○ | ○ | ○ | ○ | x | ○ | ○ |
| Background Fog | ◎ | ◎ | ◎ | ◎ | ◎ | ◎ | x | ◎ | ○ | ○ |
| Developer Inclination and Flocculation | ○ | ○ | ○ | ○ | ○ | ○ | ○ | x | ○ | ○ |

Production of Carriers e~h

Carriers e~h were produced by variously changing the types of magnetic powder used; magnetite (MTS-004; made by Toda Kogyo K.K.) having a residual magnetization of 2.9 emu/g was used in carrier e, magnetite (505AGN; made by Titanium Industries Co.) having a residual magnetization of 5.1 emu/g was used in carrier f, ferrite (DFP; made by Dowa Teppun Kogyo K.K.) having a residual magnetization of 11.8 emu/g was used in carrier g, and ferrite (XP2-4; made by TDK K.K.) having a residual magnetization of 15.1 emu/g was used in carrier h.

Saturated magnetization and residual magnetization of the carriers (external magnetic field strength: 1 KOe) were measured using a direct current magnetization characteristic auto-recording device (model 3257; made by Yokogawa Hokushin Denshi K.K.).

To a henschel mixer was added 400 parts by weight of each magnetic powder described above, 100 parts by weight polyester resin (Tafton NE1110; made by Kao K.K.), 2 parts by weight carbon black (Ketchen black; made by Lion Yushi K.K.) and 1.5 parts by weight silica (#200; made by Nippon Aerosil K.K.), and thoroughly mixed. The mixture was then fused and kneaded in a pressure kneader, and after cooling the kneaded material was coarsely pulverized using a feather mill, finely pulverized using a jet mill, and classified using an air classifier. Heat processing was accomplished using a Surfusing System (made by Japan Pneumatic Industries Co.) to obtain carrier e~h having an average particle size of 90 μm.

Production of Carriers i and j

Carriers i and j were produced using 700 parts by weight ferrite (XP3-3; made by TDK K.K.) having a residual magnetization of 19.0 emu/g in carrier i, and 700 parts by weight ferrite (MFP-2; made by TDK K.K.) having a residual magnetization of 16.1 emu/g in carrier j. Materials other than the aforementioned magnetic powders were identical to those used in the previously described production of carrier e, and mixing, fusing and kneading, pulverization, classification, and heat processing were handled identically to that of the production of carrier e, so as to obtain carriers i and j having an average particle size of 40 μm.

Table 4 shows the mean particle size of carriers e~j, and the residual magnetizations of the magnetic powders used in the production of the carriers.

TABLE 4

| Carrier Type | Average Particle Size [μm] | Residual Magnetization of Carrier Particles [emu/g] |
|---|---|---|
| e | 90 | 2.9 |
| f | 90 | 5.1 |
| g | 90 | 11.8 |
| h | 90 | 15.1 |
| i | 40 | 19.0 |
| j | 40 | 16.1 |

Experimental Examples 11~28

Carriers e and i were mixed in experimental examples 11~13, carriers f and i were mixed in experimental examples 14~16, carriers g and i were mixed in experimental examples 17~19 in the proportions shown in Table 5 to obtain carriers of experimental example 11~19. Carriers h and j were mixed in the proportions shown in Table 6 to obtain carriers of experimental examples 20~22. Carrier e was used by itself in experimental example 23, carrier f was used by itself in experimental example 24, carrier g was used by itself in experimental example 25, carrier h was used by itself in experimental example 26, carrier i was used by itself in experimental example 27, and carrier j was used by itself in experimental example 28.

Measurement of Saturated Magnetization and Residual Magnetization

The saturated magnetization δs and residual magnetization δr of each carrier of experimental examples 11~19 were measured using a direct current magnetization auto recording device (model 3257; made by Yokogawa Denshi K.K.).

TABLE 5

| Experimental Example | Carrier type and content [percent by weight] e | f | g | i | Saturated Magnetization after mixing σs [emu/g] | Residual Magnetization after mixing σr [emu/g] |
|---|---|---|---|---|---|---|
| 11 | 70 | | | 30 | 52.3 | 6.4 |
| 12 | 60 | | | 40 | 53.6 | 8.1 |
| 13 | 50 | | | 50 | 55.0 | 9.9 |
| 14 | | 70 | | 30 | 50.0 | 8.0 |
| 15 | | 60 | | 40 | 51.1 | 9.6 |
| 16 | | 50 | | 50 | 52.6 | 11.2 |
| 17 | | | 70 | 30 | 51.1 | 10.9 |
| 18 | | | 60 | 40 | 52.4 | 12.0 |
| 19 | | | 50 | 50 | 53.3 | 13.3 |

The saturated magnetization δs and residual magnetization δr of each carrier of experimental examples 20~28 were measured in the same manner as the carriers of experimental examples 11~19. Measurement results are shown Table 6.

TABLE 6

| Experimental Example | Carrier type and content [percent by weight] e | f | g | h | i | j | Saturated magnetization after mixing σs [emu/g] | Residual magnetization after mixing σr [emu/g] |
|---|---|---|---|---|---|---|---|---|
| 20 | | | | 70 | | 30 | 52.4 | 11.6 |
| 21 | | | | 60 | | 40 | 54.2 | 12.3 |
| 22 | | | | 50 | | 50 | 55.0 | 12.6 |
| 23 | 100 | | | | | | 49.6 | 1.4 |
| 24 | | 100 | | | | | 45.6 | 3.6 |
| 25 | | | 100 | | | | 47.5 | 7.7 |
| 26 | | | | 100 | | | 49.4 | 10.1 |
| 27 | | | | | 100 | | 59.5 | 18.4 |
| 28 | | | | | | 100 | 58.6 | 15.5 |

Evaluation of Carrier Collection Amount, Background Fog, Image Density Irregularity and Image Quality Toner having a particle size of 8 μm (Di-30 Toner; made by Minolta, Co., Ltd.) was added to the various carriers of experimental examples 11~28 to obtain developers having a toner concentration of 4 percent by weight. The obtained developers were loaded in a commercial copying machine (model Di-30; made by Minolta Co. Ltd.) and test copies were made. The amount of carrier contained in the developer collected by the cleaning device within the copying machine (amount of collected carrier) was measured. Furthermore, the condition of background fog occurring when toner was replenished, and the occurrence of image density irregularities in the formed images as well as image quality were also investigated.

The amount of collected carrier was evaluated by performing 1,000 image formations, baking the carrier and toner collected by the cleaning device and determining the carrier content. The evaluation standards were as follows: ○ indicates a carrier content of 0~80 mg/1,000 sheets; Δ indicates a carrier content of 80~120 mg/1,000 sheets; and X indicates a carrier content of 120 mg or more per 1,000 sheets.

Background fog was evaluated by making copies while continuously replenishing toner under low humidity conditions of 30% humidity, and visually checking the condition of fog in the white image areas. The evaluation standards were as follows: ◎ indicates no fog; ○ indicates slight fog posing no problem for image quality; Δ indicates borderline level fog just acceptable; and X indicates severe fog affecting image quality.

Image density irregularities were evaluated for images obtained after making 1,000 continuous copies of an image having 30% black area by measuring the difference in image density (ID) of both ends portions and the middle portion of the image. The evaluation standards are as follows: ○ indicates an image density difference of less than 0.03 at an image density ID of 1.30 or greater; Δ indicates a density difference of less than 0.03 at an image density of less than 1.30; X indicates a density difference of 0.03 or greater.

Image quality was evaluated visually by copying an image having an image density of 0.4, and visually examining the texture of the obtained image. The evaluation standards are as follows: ○ indicates an excellent image; and X indicates an image with rough texture unsuitable for practical use.

Evaluation results are shown in Tables 7 and 8.

TABLE 7

| | Experimental Examples 11 | 12 | 13 | 14 | 15 | 16 | 17 | 18 | 19 |
|---|---|---|---|---|---|---|---|---|---|
| Amount of Collected Carrier | ○ | ○ | ○ | ○ | ○ | ○ | ○ | ○ | ○ |
| Background Fog | ◎ | ◎ | ◎ | ◎ | ◎ | ◎ | ◎ | ◎ | ◎ |
| Image Density Irregularity | ○ | ○ | ○ | ○ | ○ | ○ | ○ | ○ | ○ |
| Image Quality | ○ | ○ | ○ | ○ | ○ | ○ | ○ | ○ | ○ |

TABLE 8

| | Experimental Examples 20 | 21 | 22 | 23 | 24 | 25 | 26 | 27 | 28 |
|---|---|---|---|---|---|---|---|---|---|
| Amount of Collected Carrier | ○ | ○ | ○ | ○ | ○ | ○ | ○ | x | x |
| Background Fog | Δ | ○ | ○ | x | x | x | x | ◎ | ◎ |
| Image Density Irregularity | Δ | Δ | Δ | Δ | Δ | Δ | Δ | x | x |
| Image Quality | ○ | ○ | ○ | x | x | x | x | x | x |

Figure 2:
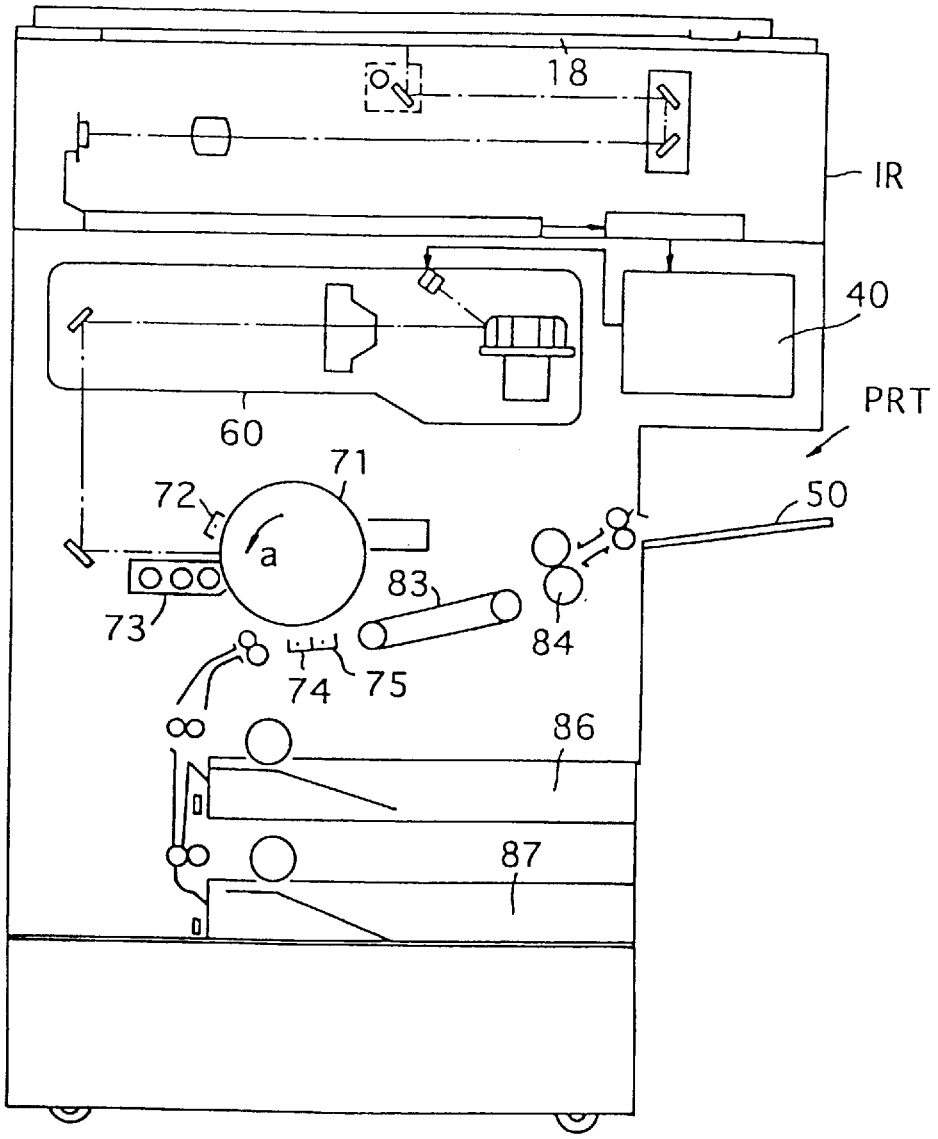
FIG. 2 shows an apparatus for smoothness processing of the carrier surface.

The construction and operation of the model Di-30 copying machine are briefly described below. FIG. 2 is a section view showing the construction of the Di-30 copying machine. As shown in FIG. 2, the Di-30 copying machine comprises an image reader unit IR for reading the image of documents placed on glass platen 18 and converting the read image to image signals, and an image forming unit PRT for forming images on copy sheets. Image forming unit PRT comprises a laser beam scanner 60 for laser irradiation, print process section 40 for driving said laser beam scanner 60 based on image data input from the image reader unit IR, photosensitive drum 71, and processing devices disposed around the periphery of said photosensitive drum 71 including a charger 72, developing device 73, transfer charger 74, and separation charger 75, paper supply unit 86, 87 for supplying copy sheets to photosensitive drum 71, a pair of fixing rollers 84 for fixing the toner image on the copy sheet, and copy sheet transport belt 83 for transporting the copy sheet to the pair of fixing rollers 84.

Image formation is accomplished in the manner described below. First, image reader IR reads a document image. Photosensitive drum 71 starts to rotate in the arrow a direction in the drawing, and the surface of the drum is uniformly charged by charger 72. Print process section 40 drives the laser scanner 60 in accordance with image data transmitted from image reader IR so as to form an electrostatic latent image by irradiating the charged surface of photosensitive drum 71. The electrostatic latent image is developed by developing device 73 so as to form a toner image. On the other hand, a copy sheet from paper cassette 86 or 87 is supplied to photosensitive drum 71 synchronously with the toner image formed on the surface of photosensitive drum 71. The toner image is transferred onto the copy sheet at the region where transfer charger 74 is opposite photosensitive drum 71. Thereafter, the copy sheet is separated from the photosensitive drum 71 by separation charger 75, and transported to the pair of fixing rollers 84 by the transport belt 83. The toner image on the copy sheet is fused to the sheet by the pair of fixing rollers 84. Subsequently, the copy sheet is ejected to a discharge tray 50.

Production of Carriers k and l

To a henschel mixer were added 100 parts by weight of polyester resin (Tafton NE1110; made by Kao K.K.) as a binder resin, 400 parts by weight ferrite (MFP-2; made by TDK K.K.) as a magnetic powder, 2 parts by weight carbon black (Ketchen black; Lion Yushi K.K.) and 1.5 parts by weight silica (#200; made by Nippon Aerosil K.K.), and thoroughly mixed. The mixture was then fused and kneaded in a pressure kneader. After cooling, the kneaded material was coarsely pulverized using a feather mill, finely pulverized using a jet mill, and classified using an air classifier. Heat processing was accomplished using a Surfusing System (made by Japan Pneumatic Industries Co.) to obtain carrier k having an average particle size of 90 $\mu$m.

Then, the surface of carrier k was smoothed using Angmill (made by Hosokawa Micron K.K.) to obtain carrier l.

Figure 3A:
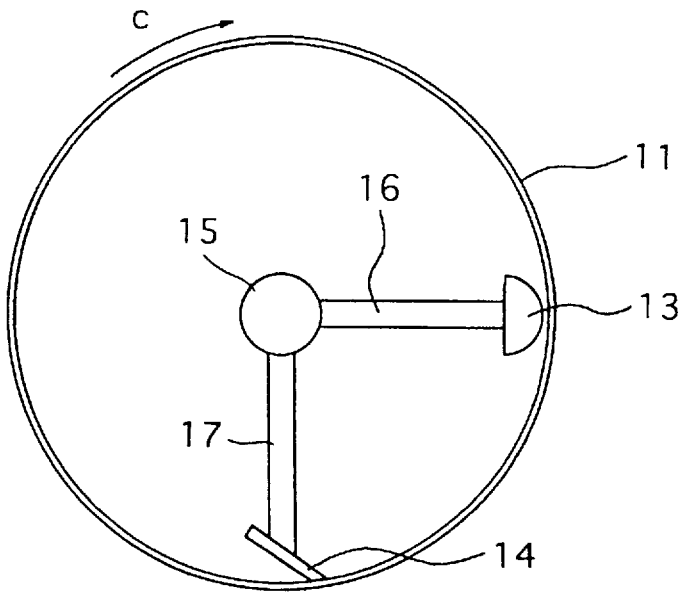
FIGS. 3(*a*) to 3(*c*) briefly show a part of the apparatus for smoothness processing of the carrier surface.
Figure 3B:
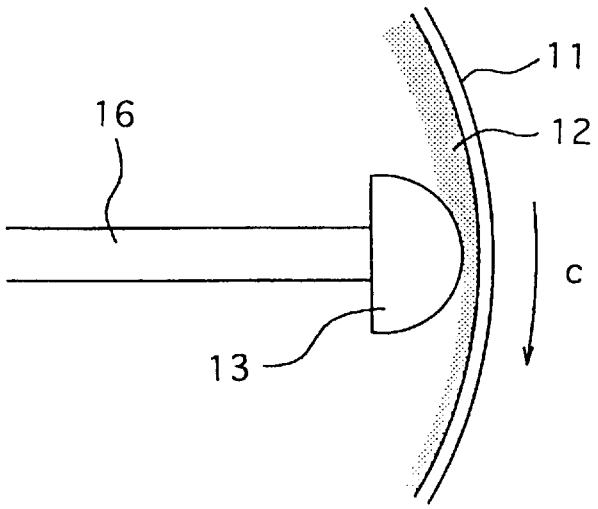
Figure 3C:
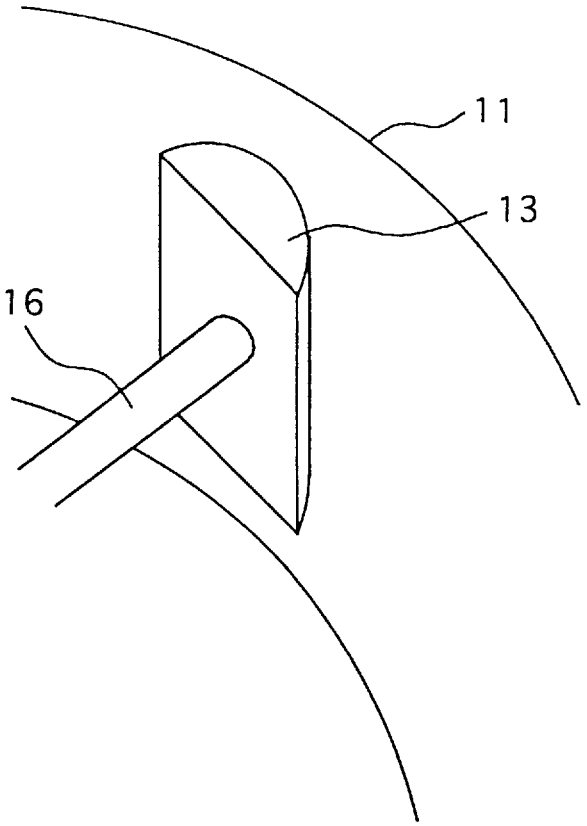

FIGS. 3(*a*) to 3(*c*) show the construction of the Angmill. FIG. 3(*a*) is a section view of the Angmill, FIG. 3(*b*) illustrates the process conditions, and FIG. 3(*c*) is a partial enlargement. As shown in FIG. 3(*a*), the Angmill has a cylindrical casing 11 which is capable of rotation, and is internally provided with a shaft 15 which is flat in the lengthwise direction of the cylindrical casing 11, two arms 16 and 17 fixedly attached to said shaft 15, pulverizing chipper 13 provided at the tip of arm 16, and scraping member 14 provided at the tip of arm 17. As shown in FIG. 3(*c*), pulverizing chipper 13 has a curved surface with a radius of curvature smaller than the surface of the opposing casing 11. Pulverizing chipper 13 is disposed with a minute spacing between pulverizing chipper 13 and the opposing casing 11.

In the carrier smoothing process, as shown in FIG. 3(*a*), casing 11 is rotated at high speed in the arrow c direction, and the carrier particles within the casing 11 are pressed against the interior wall of casing 11 by centrifugal force. At the same time, as shown in FIG. 3(*b*), the carrier particles pressed against the interior wall pass through the gap between the interior wall of casing 11 and the pulverizing chipper 13 so as to be narrower than carrier particle layer 12 formed on the interior wall of said casing 11 by centrifugal force. The surface of the carrier particles is smoothed via the action of the strong compression force and friction force during the aforementioned passage. The smooth-surfaced carrier particles are scraped from the interior wall of casing 11 by scraping member 14.

In the present embodiment, the rotation of the casing 11 is adjusted so as to achieve friction heat of 90° C. via the pressing force during passage, and processing is performed for 10 min.

Production of Carrier m

To a henschel mixer were added 100 parts by weight of polyester resin (Tafton NE1110; made by Kao K.K.) as a binder resin, 700 parts by weight ferrite (MFP-2; made by TDK K.K.) as a magnetic powder, 2 parts by weight carbon black (Ketchen black; made by Lion Yushi K.K.) and 1.5 parts by weight silica (#200; made by Nippon Aerosil K.K.), and thoroughly mixed. The mixture was then fused and kneaded in a pressure kneader. After cooling, the kneaded material was coarsely pulverized using a feather mill, finely pulverized using a jet mill, and classified using an air classifier. Heat processing was accomplished using a Surfusing System (made by Japan Pneumatic Industries Co.) to obtain carrier m having a mean particle size of 40 $\mu$m.

Experimental Examples 29~37

Carrier l and carrier m were mixed in experimental examples 29~31, and carrier k and carrier m were mixed in experimental examples 32~34 in the proportions shown in Table 9 to produce carriers of experimental example 29~34. Carrier k was used by itself in experimental example 35, carrier l was used by itself in experimental example 36, and carrier m was used by itself in experimental example 37.

Measurement of Saturated Magnetization and Aerated Apparent Density

The saturated magnetization $\delta s$ and residual magnetization $\delta r$ of each carrier of experimental examples 29~37 were measured using a direct current magnetization characteristic autorecording device (model 3257; made by Yokogawa Hokushin Denshi K.K.). The aerated apparent density (AD value) of the various carriers was measured using a powder tester (made by Hosokawa Micron K.K.). Measurement results are shown in Table 9.

TABLE 9

| Experimental | Carrier Type and Content [percent by weight] | | | Saturated Magnetization after mixing $\sigma s$ | Residual Magnetization after mixing $\sigma r$ | AD Value |
|---|---|---|---|---|---|---|
| Examples | k | l | m | [emu/g] | [emu/g] | [g/cc] |
| 29 | | 70 | 30 | 52.5 | 12.2 | 1.567 |
| 30 | | 60 | 40 | 54.5 | 12.5 | 1.582 |
| 31 | | 50 | 50 | 55.5 | 13.3 | 1.598 |

TABLE 9-continued

| Experimental Examples | Carrier Type and Content [percent by weight] k | l | m | Saturated Magnetization after mixing σs [emu/g] | Residual Magnetization after mixing σr [emu/g] | AD Value [g/cc] |
|---|---|---|---|---|---|---|
| 32 | 70 | | 30 | 52.6 | 12.0 | 1.467 |
| 33 | 60 | | 40 | 54.4 | 12.6 | 1.497 |
| 34 | 50 | | 50 | 55.8 | 13.3 | 1.515 |
| 35 | 100 | | | 46.8 | 10.0 | 1.399 |
| 36 | | 100 | | 46.6 | 10.1 | 1.543 |
| 37 | | | 100 | 58.6 | 15.5 | 1.624 |

Measurement of Carrier Collection Amount, Background Fog, and Image Irregularity and Flocculation Toner having a particle size of 8 μm (Di-30 Toner made by Minolta Co., Ltd.) was added to the various carriers of experimental examples 29~37 to obtain developers having a toner concentration of 4 percent by weight. The obtained developers were loaded in a commercial copying machine (model Di-30; made by Minolta Co. Ltd.) and copy testing was performed. The amount of carrier contained in the developer collected by the cleaning device within the copier (amount of collected carrier) was measured. Furthermore, the condition of background fog occurring when copying was made with continuous toner replenishment under low humidity condition of 30% humidity, and image density irregularities in the formed image and flocculation within the developing device were also investigated.

The amount of collected carrier was evaluated by baking the developer collected by the cleaning device after forming 1,000 images and determining the carrier content. The evaluation standards were as follows: ○ indicates a carrier content of 0~80 mg/1,000 sheets; Δ indicates a carrier content of 80~120 mg/1,000 sheets; and X indicates a carrier content of 120 mg or more per 1,000 sheets.

Background fog was evaluated by checking the fog condition in the white image regions. The evaluation standards were as follows: ⊙ indicates no fog; ○ indicates slight fog posing no problem for image quality; Δ indicates borderline level fog just acceptable; and X indicates severe fog affecting image quality.

Image density irregularities in the images was evaluated by measuring the difference in image density (ID) of both end portions and the middle portion of images obtained after making 1,000 continuous copies of an image having 30% black region. The evaluation standards are as follows: ○ indicates an image density difference of less than 0.03 at an image density ID of 1.30 or greater; Δ indicates a density difference of less than 0.03 at an image density of less than 1.30; X indicates a density difference of 0.03 or greater.

The presence of inclination and flocculation of the developer in the developing device was evaluated by visual inspection. The evaluation standards were as follows: ○ indicates the absence of flocculate and developer inclination; and X indicates the presence of flocculate and developer polarization. Evaluation results are shown in Table 10.

TABLE 10

| | Experimental Examples 29 | 30 | 31 | 32 | 33 | 34 | 35 | 36 | 37 |
|---|---|---|---|---|---|---|---|---|---|
| Amount of Collected Carrier | ○ | ○ | ○ | ○ | ○ | ○ | ○ | ○ | x |
| Background Fog | ⊙ | ⊙ | ⊙ | ○ | ○ | ○ | x | x | ⊙ |

TABLE 10-continued

| | Experimental Examples 29 | 30 | 31 | 32 | 33 | 34 | 35 | 36 | 37 |
|---|---|---|---|---|---|---|---|---|---|
| Image Density | ○ | ○ | ○ | Δ | Δ | Δ | Δ | Δ | x |
| Irregularity Flocculation | ○ | ○ | ○ | ○ | ○ | ○ | ○ | ○ | x |

Although the present invention has been fully described by way of examples with reference to the accompanying drawings, it is to be noted that various changes and modifications will be apparent to those skilled in the art.

Therefore, unless otherwise such changes and modifications depart from the scope of the present invention, they should be construed as being included therein.

What is claimed is:

1. Carrier particles for electrostatic latent image development comprising:

first particles comprising a binder resin and a magnetic powder dispersed therein, said first particles having an average particle size of 80 to 150 μm; and second particles comprising a binder resin and a magnetic powder dispersed therein, said second particles having an average particle size smaller than said first particles, and said second particles having a saturated magnetization under an external magnetic field of 1 KOe greater than said first particles.

2. Carrier particles as claimed in claim 1 wherein the average particle size of said second particles is in the range of 15 to 50 μm.

3. Carrier particles as claimed in claim 1 wherein the saturated magnetization of said first particles is 50 emu/g or below.

4. Carrier particles as claimed in claim 1 wherein the saturated magnetization of said second particles is 55 emu/g or above.

5. Carrier particles as claimed in claim 1 wherein said second particles are contained in an amount of 30 to 70 percent by weight relative to the carrier particles.

6. Carrier particles as claimed in claim 1 wherein said first particles further contain a magnetic powder fixed on surfaces thereof.

7. Carrier particles as claimed in claim 6 wherein said magnetic powder fixed on surfaces of said first particles has a specific surface area of 8 to 12 $m^2/g$.

8. Carrier particles as claimed in claim 7 wherein said magnetic powder fixed on surfaces of said first particles is contained in an amount of 50 to 200 parts by weight per 100 parts by weight of the binder resin of said first particles.

9. Carrier particles as claimed in claim 6 wherein said first particles are obtained by passing a mixture of a magnetic powder and particles which comprise a binder resin containing a magnetic powder dispersed therein through a gap between a rotating drum and a chipper having an exterior surface with a radius of curvature smaller than that of said drum.

10. Carrier particles as claimed in claim 6 wherein said first particles are obtained by heating a mixture of a particles comprising a binder resin containing a magnetic powder dispersed therein and a magnetic powder.

11. Carrier particles as claimed in claim 1 wherein surfaces of said first particles are smoothed.

12. Carrier particles as claimed in claim 11 wherein the surfaces of said first particles are smoothed by passing said first particles through a gap between a rotating drum and a chipper having an exterior surface with a radius of curvature smaller than that of said drum.

13. Carrier particles for electrostatic latent image development comprising:

first particles comprising a binder resin and a magnetic powder dispersed therein; and second particles comprising a binder resin and a magnetic powder dispersed therein, said second particles having an average particle size smaller than said first particles, said magnetic powder contained in the first particles having a residual magnetization under an external magnetic field of 1 KOe smaller than that of said magnetic powder contained in the second particles.

14. Carrier particles as claimed in claim 13 wherein the residual magnetization of said magnetic powder contained in the first particles is 13 emu/g or below.

15. Carrier particles as claimed in claim 13 wherein the residual magnetization of said magnetic powder contained in the second particles is in the range of 17 to 30 emu/g.

16. Carrier particles for electrostatic latent image development comprising a binder resin and a magnetic powder dispersed therein, said carrier particles having at least two peaks in a particle size distribution, said carrier particles having a saturated magnetization of 45 to 65 emu/g and a residual magnetization of 20 emu/g or below, wherein said saturated magnetization and said residual magnetization are measured under an external magnetic field of 1 KOe, and said peaks in the particle size distribution are in a range of 15 to 50 $\mu$m and 80 to 150 $\mu$m.

17. Carrier particles as claimed in claim 16 wherein the saturated magnetization is in the range of 50 to 60 emu/g and the residual magnetization is 15 emu/g or below.

18. Carrier particles as claimed in claim 16 wherein said binder resin is at least one resin selected from the group consisting of styrene resin, acryl resin, styrene-acryl resin, polyolefin resin, polyester resin and epoxy resin.

19. Carrier particles as claimed in claim 16 which further comprise a dispersion stabilizer for the magnetic powder, said dispersion stabilizer being contained in an amount of 0.01 to 10 percent by weight relative to the carrier particles.

20. Carrier particles as claimed in claim 19 wherein the content of said dispersion stabilizer is in the range of 0.01 to 3 percent by weight relative to the carrier particles.

21. Carrier particles as claimed in claim 16 wherein said magnetic powder has a primary particle size of 2 $\mu$m or below.

22. Carrier particles for electrostatic latent image development comprising:

first particles comprising a binder resin and a magnetic powder dispersed therein; and second particles comprising a binder resin and a magnetic powder dispersed therein, said first particles having a saturated magnetization under an external magnetic field of 1 KOe smaller than said second particles, a residual magnetization under an external magnetic field of 1 KOe of said first particles being 15 emu/g or below and that of said second particles being 16 to 30 emu/g, and said first particles having an average particle size of 80–150 $\mu$m, and said second particles having an average particle size smaller than said first particles.

23. The carrier particles as claimed in claim 22, wherein the saturated magnetization of said first particles in 50 emu/g or below and that of said second particles is 55 emu/g or above.

24. The carrier particles as claimed in claim 22, wherein the residual magnetization of said magnetic powder contained in the first particles is 13 emu/g or below and that of said magnetic powder contained in said second particles is 17 to 30 emu/g.

25. Carrier particles for electrostatic latent image development comprising:

first particles comprising a binder resin and a magnetic powder dispersed therein; and second particles comprising a binder resin and a magnetic powder dispersed therein, said magnetic powder contained in the first particles having a residual magnetization under an external magnetic field of 1 KOe smaller than that of said magnetic powder contained in the second particles.

26. The carrier particles as claimed in claim 25, wherein the residual magnetization of said magnetic powder contained in the first particles to 13 emu/g or below and that of said magnetic powder contained in said second particles is 17 to 30 emu/g.

27. A developer for developing an electrostatic latent image comprising:

(a) a toner comprising a binder resin and a colorant; and (b) carrier particles comprising;

first particles comprising a binder resin and a magnetic powder dispersed therein; and second particles comprising a binder resin and a magnetic powder dispersed therein, said second particles having an average particle size smaller than said first particles, said first particles having a saturated magnetization under an external magnetic field of 1 KOe smaller than said second particles, wherein said first particles contain a magnetic powder fixed on surfaces thereof.

28. The developer as claimed in claim 27 wherein said surfaces of said first particles are smoothed.

29. The developer as claimed in claim 27 wherein said magnetic powder dispersed in the first particles has a residual magnetization under an external magnetic field of 1 KOe smaller than that of said magnetic powder dispersed in the second particles.

30. The developer as claimed in claim 27 wherein said toner has a volume average particle size of 9 $\mu$m or below.

31. The developer as claimed in claim 30 wherein the toner volume average particle size is in the range of 4 to 9 $\mu$m.

32. An image forming method comprising steps of:

forming an electrostatic latent image;

stirring a developer, said developer comprising a toner and carrier particles, and said toner comprising a binder resin and a colorant, said carrier particles comprising first and second particles comprising a binder resin and a magnetic powder dispersed therein, said second particles having an average particle size smaller than said first particles, said first particles having a saturated magnetization under an external magnetic field of 1 KOe smaller than said second particles, and said first particles having an average particle size of 80 to 150 $\mu$m, wherein surfaces of said first particles are smoothed;

forming a magnetic brush of the stirred developer; and making contact the magnetic brush with the electrostatics latent image.

33. The image forming method as claimed in claim 32, wherein the saturated magnetization of said first particles is 50 emu/g or below and that of said second particles is 55 emu/g or above.

* * * * *